US008844714B2

(12) United States Patent
Long

(10) Patent No.: US 8,844,714 B2
(45) Date of Patent: Sep. 30, 2014

(54) FUEL AND CHEMICAL CONTAINERS WITH VAPOR FILTRATION

(76) Inventor: Shawn R. Long, North Liberty, IN (US)

( * ) Notice: Subject to any disclaimer, the term of this patent is extended or adjusted under 35 U.S.C. 154(b) by 885 days.

(21) Appl. No.: 13/036,342

(22) Filed: Feb. 28, 2011

(65) Prior Publication Data

US 2011/0215098 A1 Sep. 8, 2011

Related U.S. Application Data

(60) Provisional application No. 61/309,531, filed on Mar. 2, 2010.

(51) Int. Cl.
*B65D 85/00* (2006.01)
*B67D 7/04* (2010.01)
*B67D 7/00* (2010.01)

(52) U.S. Cl.
CPC ..... *B67D 7/005* (2013.01); *B67D 7/0476* (2013.01); *Y10S 215/902* (2013.01)
USPC ..... 206/0.7; 206/524.1; 220/560.03; 220/567.2; 215/902

(58) Field of Classification Search
USPC ..... 206/0.6, 524.1, 524.4, 0.7; 220/560.03, 220/565, 567.2, 23.83, 23.86, 23.87; 215/902
See application file for complete search history.

(56) References Cited

U.S. PATENT DOCUMENTS 3,214,052 A 10/1965 Dike
4,541,529 A 9/1985 Hestehave et al.
4,790,445 A 12/1988 Shibata
5,066,597 A * 11/1991 Stinson et al. ..... 435/300.1
5,193,709 A 3/1993 Brassell
5,425,470 A 6/1995 Duhaime et al.
5,460,699 A 10/1995 Bilan et al.
5,704,337 A 1/1998 Stratz et al.
5,725,645 A 3/1998 Wickland et al.
5,736,043 A 4/1998 Nichols et al.

(Continued)

FOREIGN PATENT DOCUMENTS

DE 3600177 7/1986
JP 56165757 12/1981

(Continued)

OTHER PUBLICATIONS

International Search Report and Written Opinion from corresponding Patent Cooperation Treaty Application No. PCT/ US2011/026456, dated Aug. 10, 2011, which corresponds to U.S. Appl. No. 13/036,342.

*Primary Examiner* — Jacob K Ackun
(74) *Attorney, Agent, or Firm* — Gardner, Linn, Burkhart & Flory, LLP

(57) ABSTRACT

The present invention provides a chemical container or system for storing and dispensing chemicals, and in particular liquid chemicals such as fuels and the like. The chemical container has a first container portion for storing the chemical itself, and a second container portion with a vapor filter for receiving, containing, and filtering or adsorbing gases or vapors that are associated with the chemical and which may be vented from the first container portion. This dual-chamber system avoids buildup of excessive vapor pressures inside of the containers, but filters any vented gases so that noxious or undesirable vapors are not emitted into the surrounding environment. In some embodiments, the second container portion covers only a portion of the first container portion, while in other embodiments, a second container completely surrounds a first container.

21 Claims, 11 Drawing Sheets

(56) References Cited

U.S. PATENT DOCUMENTS

| | | | | |
|---|---|---|---|---|
| 5,931,141 | A * | 8/1999 | Chino | 123/520 |
| 6,571,978 | B1 | 6/2003 | Puempel et al. | |
| 6,612,458 | B2 | 9/2003 | Balzer et al. | |
| 6,619,499 | B1 * | 9/2003 | Lin | 220/371 |
| 7,566,358 | B2 | 7/2009 | Hart et al. | |
| 2002/0043156 | A1 * | 4/2002 | Shea | 96/134 |
| 2004/0154670 | A1 * | 8/2004 | Gerhardt et al. | 137/588 |
| 2006/0011173 | A1 * | 1/2006 | Davis et al. | 123/520 |
| 2006/0073365 | A1 * | 4/2006 | Kaye | 429/19 |
| 2006/0180614 | A1 * | 8/2006 | Barron et al. | 222/210 |
| 2007/0077470 | A1 * | 4/2007 | Adams et al. | 429/25 |
| 2007/0269145 | A1 | 11/2007 | Eisenbarth | |
| 2009/0056827 | A1 | 3/2009 | Tschantz | |
| 2009/0080811 | A1 | 3/2009 | Stefanek et al. | |
| 2010/0038363 | A1 * | 2/2010 | Kies et al. | 220/212 |
| 2010/0294761 | A1 | 11/2010 | Riordan | |

FOREIGN PATENT DOCUMENTS

| | | |
|---|---|---|
| JP | 06-318631 | 11/1994 |
| JP | 2005013050 | 1/2005 |
| RU | 2195357 | 12/2002 |

* cited by examiner

FUEL AND CHEMICAL CONTAINERS WITH VAPOR FILTRATION

CROSS REFERENCE TO RELATED APPLICATION

The present application claims the benefit of U.S. provisional application Ser. No. 61/309,531, filed Mar. 2, 2010, which is hereby incorporated herein by reference in its entirety.

FIELD OF THE INVENTION

The present invention relates to chemical containers and, more particularly, to portable fuel containers used to store and transport chemicals, especially liquid chemicals.

BACKGROUND OF THE INVENTION

Chemical containers, such as portable fuel canisters or jugs, are typically stored in or around homes or businesses for applications in which relatively small quantities of chemicals (e.g., liquid fuels) are used. Such applications may include, for example, vehicles including watercraft, automobiles, snowmobiles, motorcycles, all-terrain vehicles and the like, and/or yard maintenance equipment, including lawnmowers, snow blowers, leaf blowers, chain saws, and the like. Typical fuel containers are vented and/or do not seal well against the venting of gaseous vapors from inside the container, which can lead to contamination of a confined storage area, or of a transport vehicle's ambient air and/or upholstery, with unpleasant and potentially harmful fumes or vapors. This can be particularly problematic on relatively warm days when heat can raise the vapor pressure inside of the container, forcing more vapors out of the container.

SUMMARY OF THE INVENTION

The present invention provides a chemical container or system equipped with a vapor filter for filtering out or adsorbing harmful vapors or gases that may be emitted or expelled from a chemical-containing portion of the container. The container includes two separate chambers: one for containing a chemical (generally a liquid chemical) and the other for trapping and filtering/adsorbing any vapors that may be emitted from the first chamber. The second chamber is in fluid communication with a vapor filter/adsorbent that permits filtered air from the second chamber to be vented into the surrounding atmosphere to substantially limit or prevent malodorous and/or harmful vapors from being emitted into the environment in which the chemical container is stored or transported.

According to one form of the present invention, a chemical container with vapor filtration includes a first container defining a first chamber for storing a chemical, a second chamber that surrounds at least a portion of the first container and defines a second chamber therebetween, and a vapor filter. The second container is configured to restrict or contain any gaseous vapors that are emitted into the second chamber from the first chamber of the first container, and includes at least one wall portion and an openable and closable portion. The vapor filter is positioned at or in the wall portion of the second container, and is in fluid communication with the second chamber and with the ambient environment. The vapor filter adsorbs the gaseous vapors from the second chamber and vents filtered or cleansed air to the ambient environment.

According to one aspect, the second container is attached and sealed to a top portion of the first container and does not completely surround the first container, so that the second chamber is defined between the second container and the top portion of the first container.

According to another aspect, the first and second containers are both substantially rigid. Optionally, the openable and closable portion of the second container is a removable lid that forms a top wall of the second container when the removable lid is attached to the wall portion of the second container. The second container may be configured to support another chemical container in stacked arrangement atop the removable lid when the removable lid is attached to the wall portion.

According to yet another aspect, the first container includes a dispensing spout that is positionable at a dispensing configuration, at least when the openable and closable portion of the second container is opened.

According to a further aspect, the second container is configured to completely surround the first container so that the second chamber is defined between the interior or inner surfaces of the second container and the entirety of the first container. Optionally, the first container is substantially rigid and the second container is made of a flexible sheet material, such as a coated fabric or a sheet film material. Optionally, the openable and closable portion of the second container includes one or more of: (i) an interlocking closure, (ii) a releasable adhesive closure, (iii) a magnetic closure, (iv) a zipper closure, and (v) a hook-and-loop closure.

According to still another aspect, the vapor filter is an activated charcoal filter capable of adsorbing gaseous hydrocarbons or the like.

According to a still further aspect, the first container is adapted to contain a liquid fuel in the first chamber, and the second container is adapted to contain and/or restrict any gaseous fuel vapors that escape the first container, substantially without emitting the fuel vapors to the ambient environment. For example, the first container may be a plastic or metal container that is adapted to contain one or more of (i) gasoline, (ii) kerosene, (iii) diesel fuel, and (iv) nitromethane fuel.

According to another form of the present invention, a portable fuel container system includes an outer enclosure that defines a chamber for receiving a fuel canister. The outer enclosure has a closable opening through which the fuel canister may be inserted or removed from the chamber. A closure member at the closable opening is configured to selectively retain the closable opening in a closed configuration with the fuel canister positioned in the chamber of the outer enclosure. A vapor filter is provided at or along the outer enclosure, and is in fluid communication with the chamber and with the ambient environment. The vapor filter is configured to adsorb any fuel vapors that are emitted by the fuel canister into the chamber when the fuel canister is positioned in the enclosure.

According to one aspect, the outer enclosure includes or defines at least one spout-receiving portion of the chamber. The spout-receiving portion is configured so that it can receive a dispensing spout of the fuel canister when the canister is positioned in the enclosure and the closable opening is in the closed configuration. Optionally, the outer enclosure defines two spout-receiving portions so that the outer enclosure can accommodate the dispensing spout of the fuel canister when the fuel canister is in either of two different orientations within the chamber.

According to another aspect, the portable fuel container system includes a fuel canister with a dispensing spout. The fuel canister is configured to contain a liquid fuel and can selectively dispense the liquid fuel via the dispensing spout.

According to a further aspect, the outer enclosure includes outer surfaces and inner surfaces. The inner surfaces define the chamber for receiving the fuel canister. The closure member is a double closure including a first corresponding pair of closure members (such as strips of hook-and-loop fastener material) disposed along respective ones of the inner surfaces of the outer enclosure at the closable opening, and a second corresponding pair of closure members (which can also be strips of hook-and-loop fastener material, for example) disposed along respective ones of the outer surfaces of the outer enclosure. The closure members of the second corresponding pair are arranged to engage one another to thereby releasably hold the closable opening in the closed configuration when the closure members of the first corresponding pair engage one another and the outer enclosure is folded or rolled at the closable opening.

Therefore, a chemical container or container system is provided that traps and filters/adsorbs malodorous and/or potentially harmful chemical vapors that may be emitted from the chemical-containing chamber of the container. This may be particularly beneficial in confined spaces, such as in vehicle interiors, where the buildup of such vapors could otherwise reach harmful levels, or which could leave lingering odors until long after the container is removed from the confined space. Thus, persons who store and/or transport fuel containers in confined spaces may be protected from exposure to chemical vapors that are inadvertently vented from chemical containers such as portable fuel canisters and the like.

These and other objects, advantages, purposes, and features of the present invention will become apparent on review of the following description in conjunction with the drawings.

DESCRIPTION OF THE PREFERRED EMBODIMENTS

Figure 1:
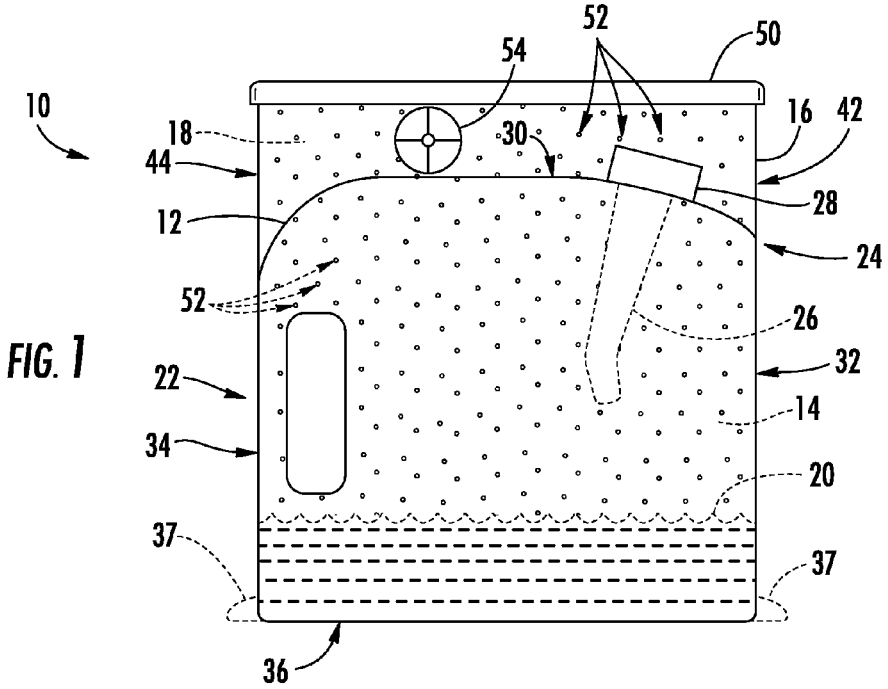
FIG. 1 is a side elevation of a chemical container in accordance with the present invention, with a lid shown in a closed and sealed position.

Referring now to the drawings and the illustrative embodiments depicted therein, a chemical container 10 is provided for use by home owners, business owners, or other persons in need of a container for transporting and storing chemicals such as liquid fuels or the like (FIGS. 1-6). The container includes a filter for substantially limiting or preventing the emissions of harmful or malodorous vapors from the chemicals stored therein, so that the chemicals may be stored or transported in confined spaces or vehicles without filling the spaces with noxious fumes or odors. Although described primarily for fuel storage applications, it will be appreciated that the present invention is equally applicable and adaptable for use in other chemical storage applications, including storage and dispensing of solid and/or pelletized chemicals (e.g., fertilizers), and particularly those that are prone to give off undesirable fumes or vapors.

Figure 2:
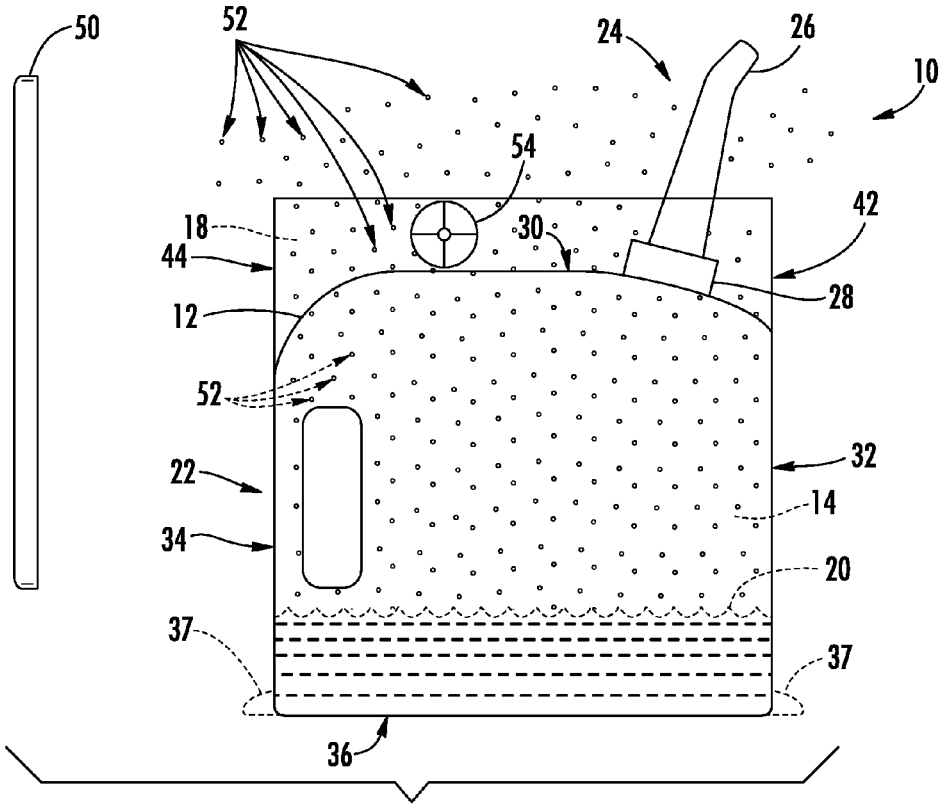
FIG. 2 is another side elevation of the chemical container of FIG. 1, with its lid in an unsealed and open configuration, and a spout in a dispensing configuration.
Figure 3:
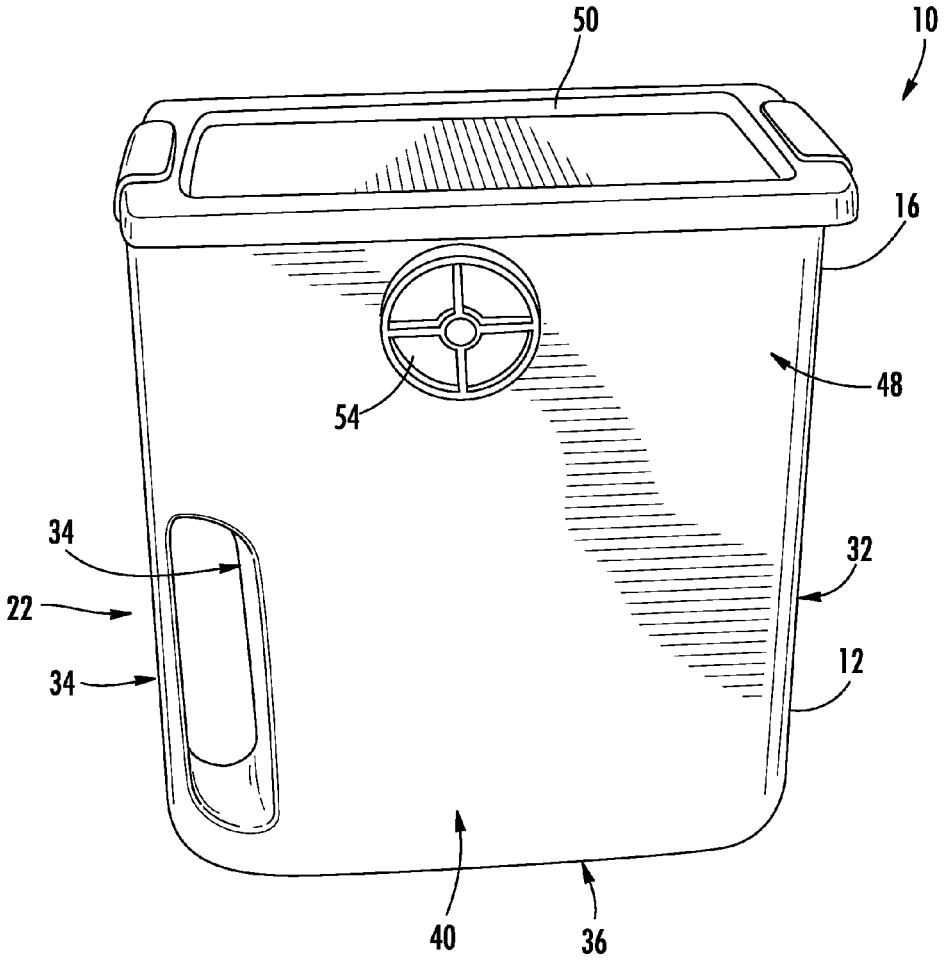
FIG. 3 is a side perspective view of another chemical container that is substantially similar to the container of FIGS. 1 and 2.
Figure 4:
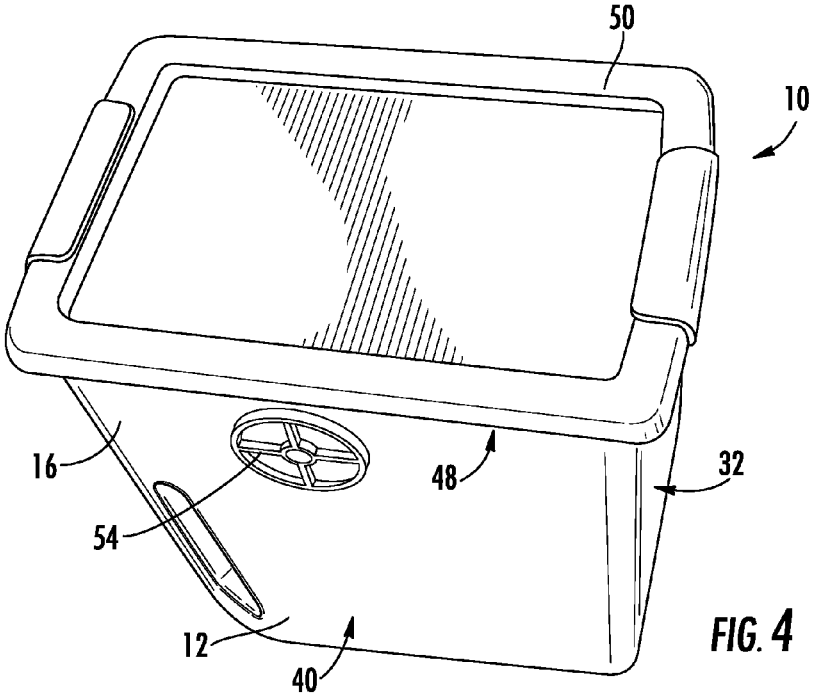
FIG. 4 is a top perspective view of the chemical container of FIG. 3.

Chemical container 10 includes a first container portion 12 defining a first chamber 14, and a second container portion 16 defining a second chamber 18 (FIGS. 1 and 2). First container portion 12 may be substantially similar to a conventional fuel container, such as a portable gasoline can or the like. First chamber 14 contains a liquid chemical such as a liquid fuel 20, for example gasoline, kerosene, diesel fuel, nitromethane fuel, or the like, and includes a handle portion 22 and a reversible spout 24. Second container portion 16 supports a vapor filter or filter cartridge 54 for venting second chamber 18, as will be described below.

In the illustrated embodiment of FIGS. 1-6, first chamber 14 is defined between a top surface or wall 30, a front wall 32, a rear wall 34, a bottom wall 36 opposite top wall 30, a left side wall 38, and a right side wall 40. Any or all of front wall 32, rear wall 34, left side wall 38, and right side wall 40 may include foot portions 37 near bottom wall 36 (FIGS. 1 and 2) that project beyond the normal perimeter or "footprint" of first container portion 12 to enhance the stability of container 10 when it is supported on a surface, such as in a storage area or in a vehicle. Optionally, foot portions may extend from bottom wall 36 in the vicinity of any or all of front wall 32, rear wall 34, left side wall 38, and right side wall 40 to achieve enhanced stabilization of the container 10. Second container 16 includes a front wall 42, a rear wall 44, a left side wall 46, a right side wall 48, and a cover or lid 50. Second chamber 18 is thus defined between front wall 42, rear wall 44, left side wall 46, right side wall 48, and cover 50 of second container 16, and the top surface or wall 30 of first container 12.

Figure 5:
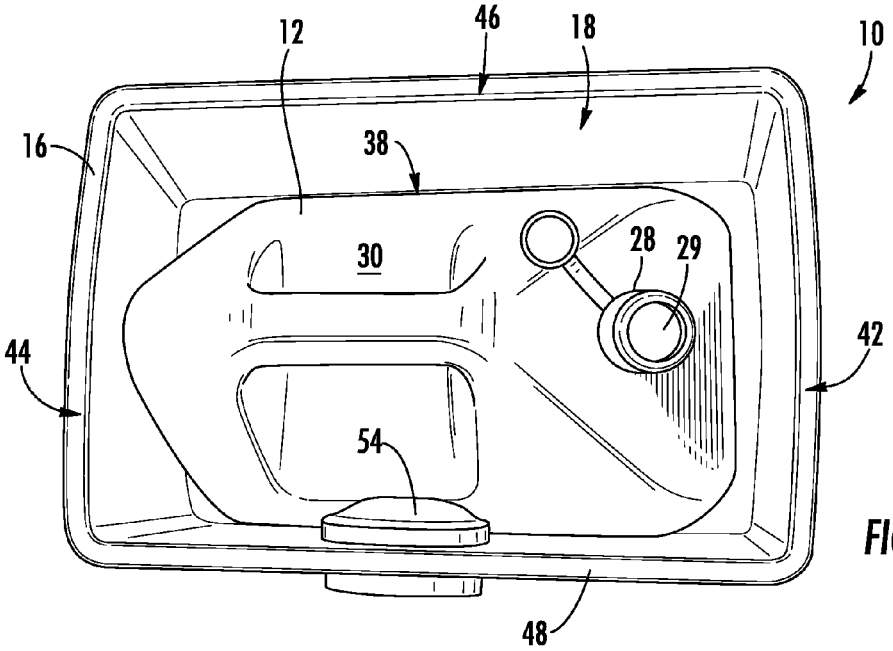
FIG. 5 is another top perspective view of the chemical container of FIG. 3, with its lid removed.

Reversible spout 24 includes a neck portion 26 (FIGS. 1 and 2), a threaded collar 28 (FIGS. 1, 2, and 5), and a removable plug 29 (FIG. 5). The neck portion 26 is repositionable between a storage configuration in which the neck is substantially contained within first chamber 14 (FIG. 1), and a dispensing configuration in which the neck 26 extends or projects above first container 12 at threaded collar 28 (FIG. 2), and is in fluid communication with first chamber 14 for purposes of dispensing the liquid fuel 20 contained therein. Reversible spout 24 is substantially conventional, in that threaded collar 28 is threadedly coupled to a threaded neck (not shown) surrounding a filling/dispensing port in a top surface 30 of first container 12. It will be appreciated that if the threaded collar 28 is not tightly sealed to the upper wall 30 of first container 12, liquid 20 may leak at the collar 28, particularly if first chamber 14 is very full and/or if container 10 is tipped. However, any such leakage would be substantially contained within second chamber 18 unless container 10 is tipped significantly (e.g. nearly horizontal) while cover 50 is removed.

First chamber 14 and second chamber 18 are separated or divided by top wall 30 of container 12. However, it will be appreciated that reversible spout 24 may provide an imperfect seal at top wall 30, or may be designed to vent first chamber 14 upon reaching a certain minimum vapor pressure, such that a certain amount of fuel vapors 52 (depicted as dots or speckles in FIGS. 1 and 2) may escape from first chamber 14 into second chamber 18. This may be particularly likely, for example, when the pressure inside of first chamber 14 exceeds that of second chamber 18. Although fuel vapor 52 may escape past reversible spout 24 in the storage configuration of FIG. 1, the liquid fuel 20 inside of first chamber 14 is typically better sealed against escape from the first chamber 14. When cover 50 is removed from second container 16 (FIG. 2), any fuel vapor 52 in second chamber 18 is permitted to escape into the surrounding atmosphere. However, when cover 50 is positioned at second container 16, the cover 50 sealingly engages front wall 42, rear wall 44, left side wall 46, and right side wall 48, so that fuel vapors 52 are not emitted outside of the first and second chambers 14, 18.

Figure 7:
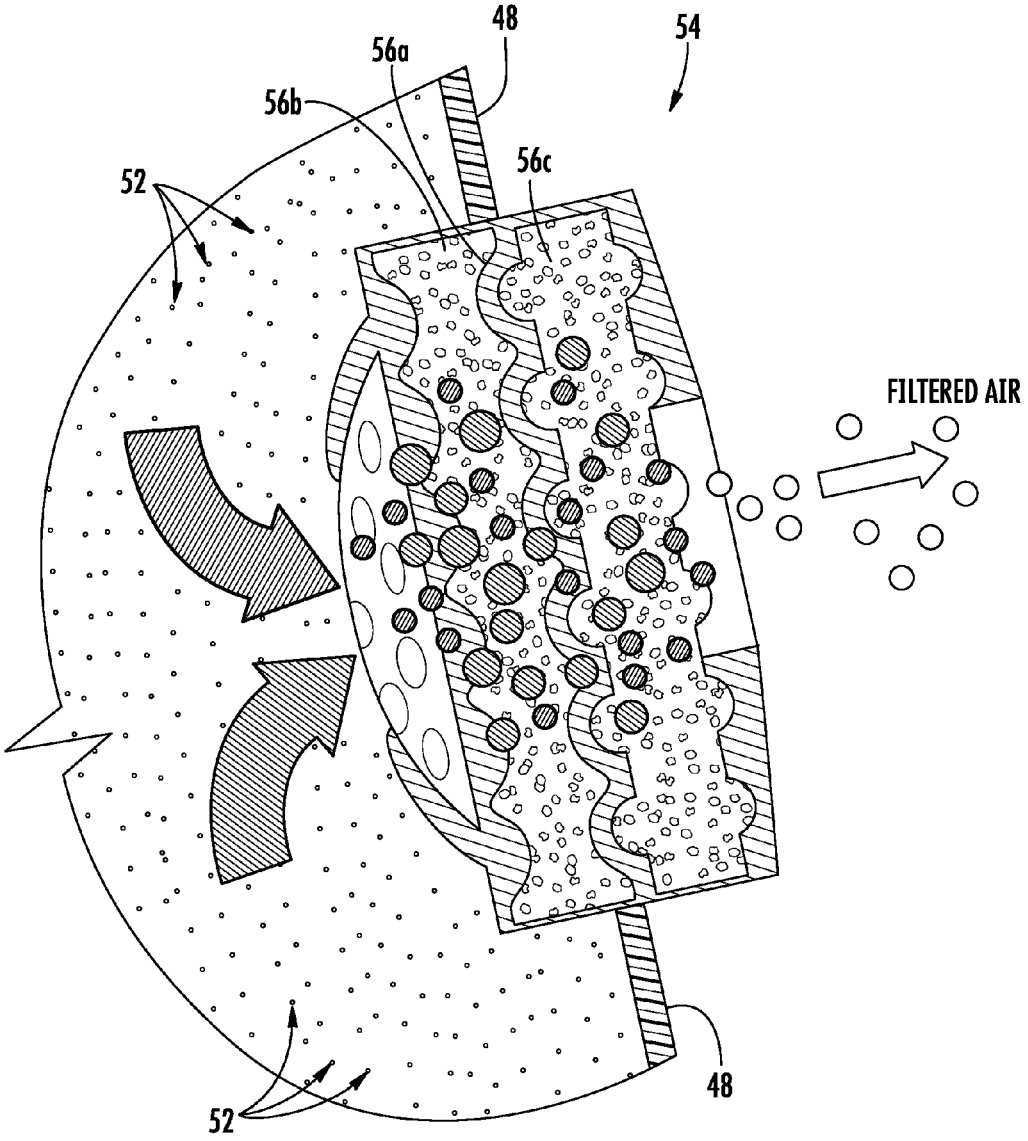
FIG. 7 is a side sectional elevation of a vapor filter suitable for use with the chemical container of the present invention.

A vapor filter/adsorbent 54 is positioned in the right side wall 48 of second container portion 16, and is designed to filter and/or adsorb fuel vapors (and/or other chemical vapors, particulate matter, and/or the like) that may be present in second chamber 18. It will be appreciated that, optionally, vapor filter 54 may be positioned along any of front wall 42, rear wall 44, left side wall 46, right side wall 48, or even the cover 50 of second container, without departing from the spirit and scope of the present invention. With cover 50 positioned atop the second container portion 16, if the vapor pressure of second chamber 18 exceeds that of the surrounding environment, the excess vapor pressure will cause the mixture of air and fuel vapor 52 in second chamber 18 to pass through vapor filter 54, which substantially filters or traps/adsorbs the fuel vapors 52 so that they are not emitted to the surrounding atmosphere. Thus, with cover 50 secured and sealed in place, fuel vapors 52 from first chamber 14 may escape into second chamber 18, but will not be released into the surrounding atmosphere (FIG. 7). Vapor filter 54 may be substantially any media filter capable of filtering or adsorbing the vapors of common fuels or solvents or other chemicals, and may include, for example, an activated charcoal filter media 56*a*, an aerosol filter media 56*b*, and a particulate filter media 56*c* (FIG. 7). Such filters may commonly be used in respirator applications, and may be readily replaceable at right side wall 48 (or other location) of second container 16, such as may be desirable if filer 54 becomes saturated.

In the illustrated embodiment, second container 16 and its cover 50 are generally rectangular in shape when viewed from above (FIGS. 4 and 5), with cover 50 having a perimeter lip 58 forming a groove or channel along its underside for receiving the upper edge portions of front wall 42, rear wall 44, left side wall 46, and right side wall 48 of second container 16. The perimeter lip 58 of cover 50 and the upper edge portions of second container 16 may include interlocking snap-together features or elements for retaining cover 50 at second container 16. Additionally, the channel defined by perimeter lip 58 may include a soft or resilient seal for sealingly engaging the upper edge portion of second container 16 so that the engagement of cover 50 with second container 16 is substantially gas or vapor-impermeable. Optionally, cover 50 and/or the upper edges or portions of second container 16 may be provided with magnets, releasable latches, hinges, or the like for removably attaching cover 50 to second container 16.

Figure 6:
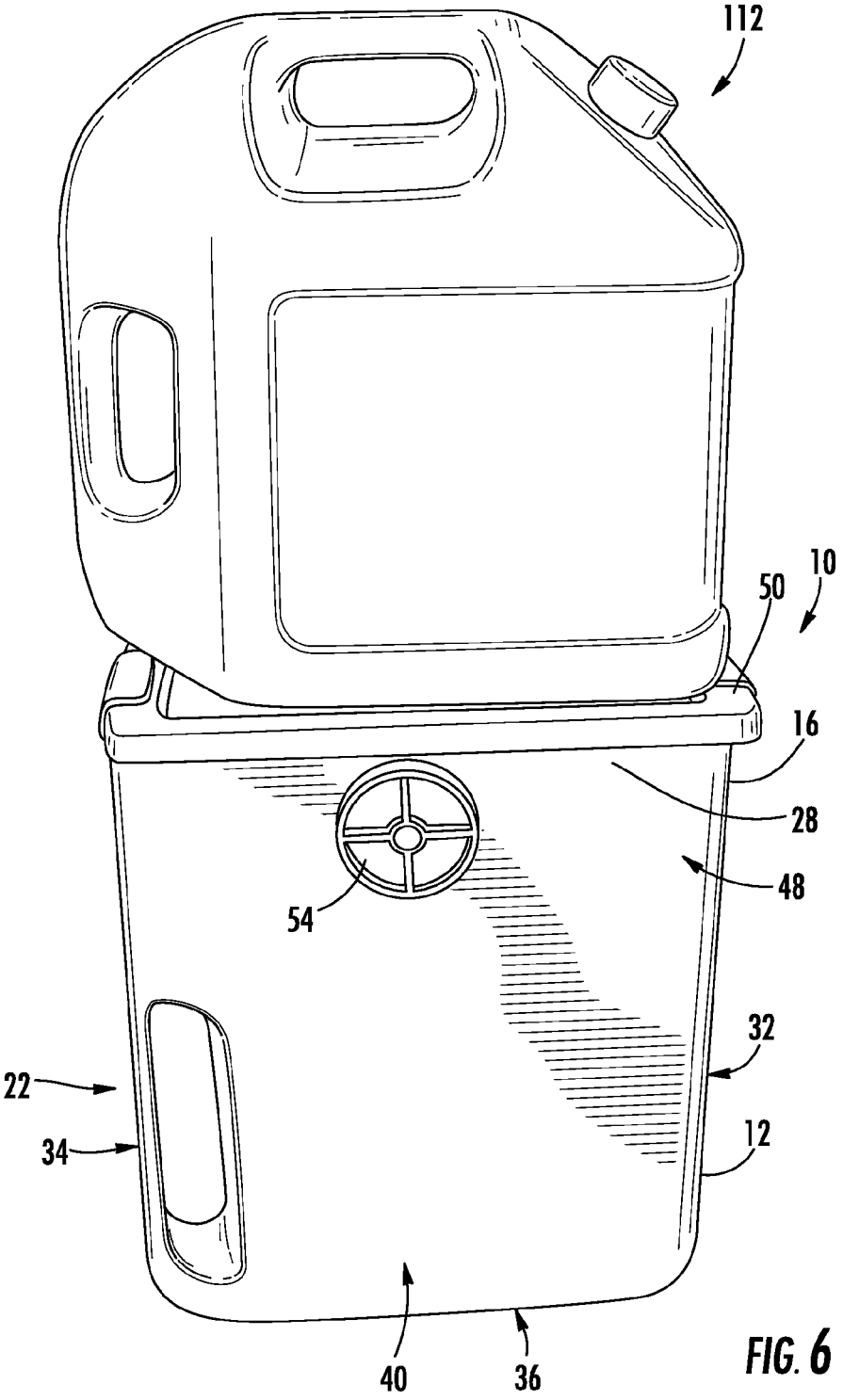
FIG. 6 is a side perspective view of the chemical container of FIG. 3, and showing a second chemical container positioned in stacked arrangement.

In the illustrated embodiment, cover 50 includes a recessed central portion 60 that is surrounded by, and offset below, perimeter lip 58. Recessed central portion 60 is generally planar and is sized and shaped to generally correspond to the dimensions of bottom wall 36 of first container 12 so that the bottom wall 36 of one container engages the recessed central portion 60 of the cover 50 of another container in a male/female relationship. This permits cover 50 to support another chemical container 10 at the recessed central portion 60 in a tip-resistant and slide-resistant stacked arrangement, such as shown in FIG. 6. In FIG. 6, a conventional fuel container 112 (having similar dimensions as first container 12 of chemical container 10) is supported at the recessed central portion 60 of cover 50 of chemical container 10, whereby perimeter lip 58 resists sliding movement of conventional fuel container 112 relative to cover 50. In this manner, multiple chemical containers 10 and/or at least one chemical container 10 and at least one conventional fuel container 112 may be stacked atop one another when they are not being used or transported.

Chemical container 10 may be made from substantially any chemical-resistant material, such as molded (including blow-molded) resinous and/or polymeric materials, metals, or the like. It will be further appreciated that first container portion 12 may be integrally or unitarily formed with the side walls 46, 48, and front and rear walls 42, 44 of second container portion 16, particularly when resinous materials are used, or may be formed in separate operations and later joined and sealed to one another such as shown in FIGS. 3-6.

Figure 8:
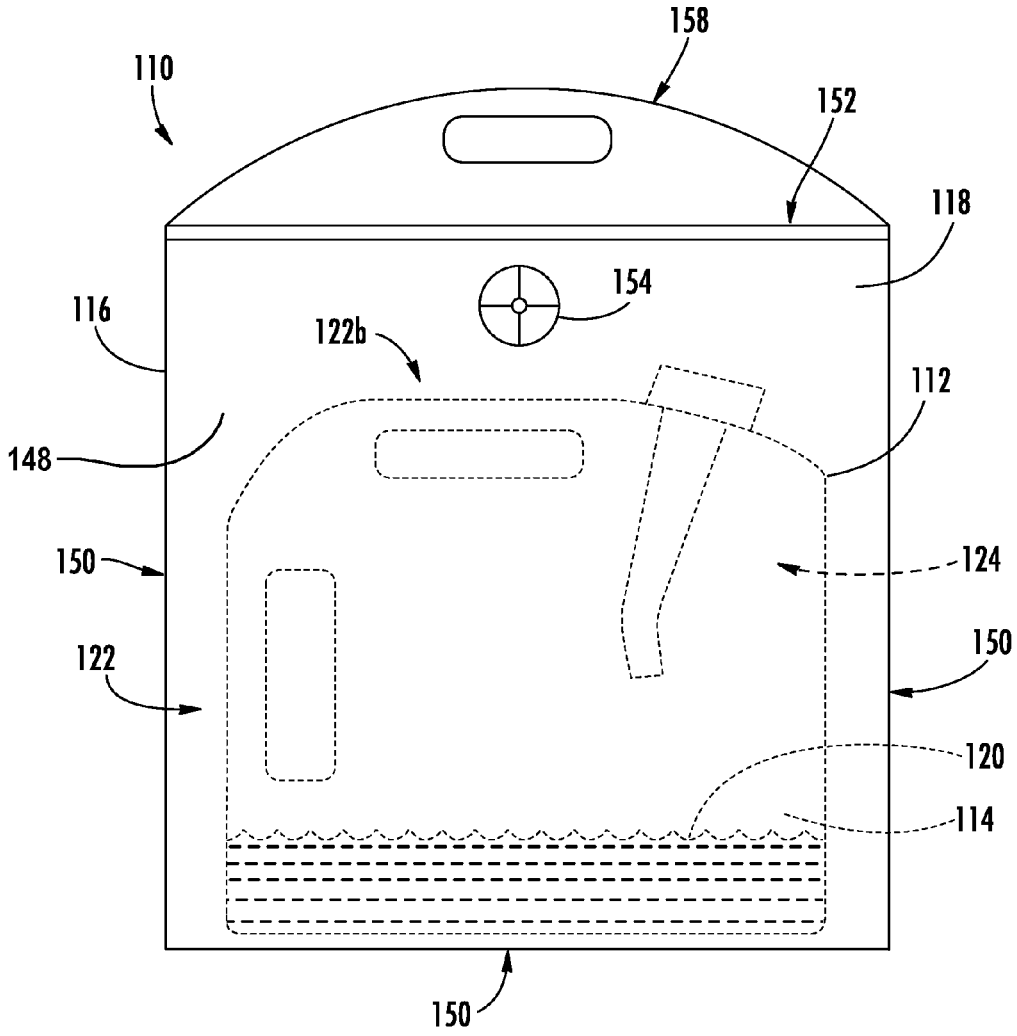
FIG. 8 is a side elevation of another chemical container in accordance with the present invention.

Referring now to FIG. 8, another chemical container or system 110 includes a conventional single-chamber fuel container 112 that is completely surrounded by and sealed inside of a larger second container 116. Conventional fuel container 112 defines a first chamber 114, while second container 116 defines a second chamber 118 in which the entirety of conventional fuel container 112 may be contained, sealed, and isolated from the surrounding environment. Conventional fuel container 112 contains a liquid fuel 120 or other chemical, and includes a handle portion 122 to aid a user in gripping the fuel container 112. Fuel container 112 further includes a reversible spout 124, and in other respects may be substantially similar to first container portion 12 of chemical container 10, described above.

Second container 116 may include opposite side walls 148 that are joined to one another along a perimeter edge 150 so that first chamber 114 is defined between the side walls 148 of second container 116. Second container 116 includes an openable and sealable portion 152 at an upper end of the container, such as a vapor-impermeable interlocking closure, releasable adhesive closure, magnetic closure, or the like, and may be resealable so that it may be used repeatedly to substantially seal off the contents of second chamber 118 from the surrounding environment. One of side walls 148 supports a vapor filter 154 that may be substantially identical or similar to vapor filter 54, described above.

Second container 116 may be formed from flexible polymer film materials, such as to form a flexible bag that is sized and shaped to receive conventional fuel container 112. Second container 116 may further include a handle portion 158 to facilitate carrying the chemical container 110 to facilitate transporting both containers 112, 116. It will be appreciated that although second container 116 surrounds the entirety of conventional fuel container 112 (FIG. 8), second container 116 provides substantially the same function as second container 16, described above, by directing vapor-laden air contained in second chamber 118 through vapor filter 154, which substantially traps/adsorbs or filters out the vapors associated with the liquid fuel 120 contained in fuel container 112.

Figure 9:
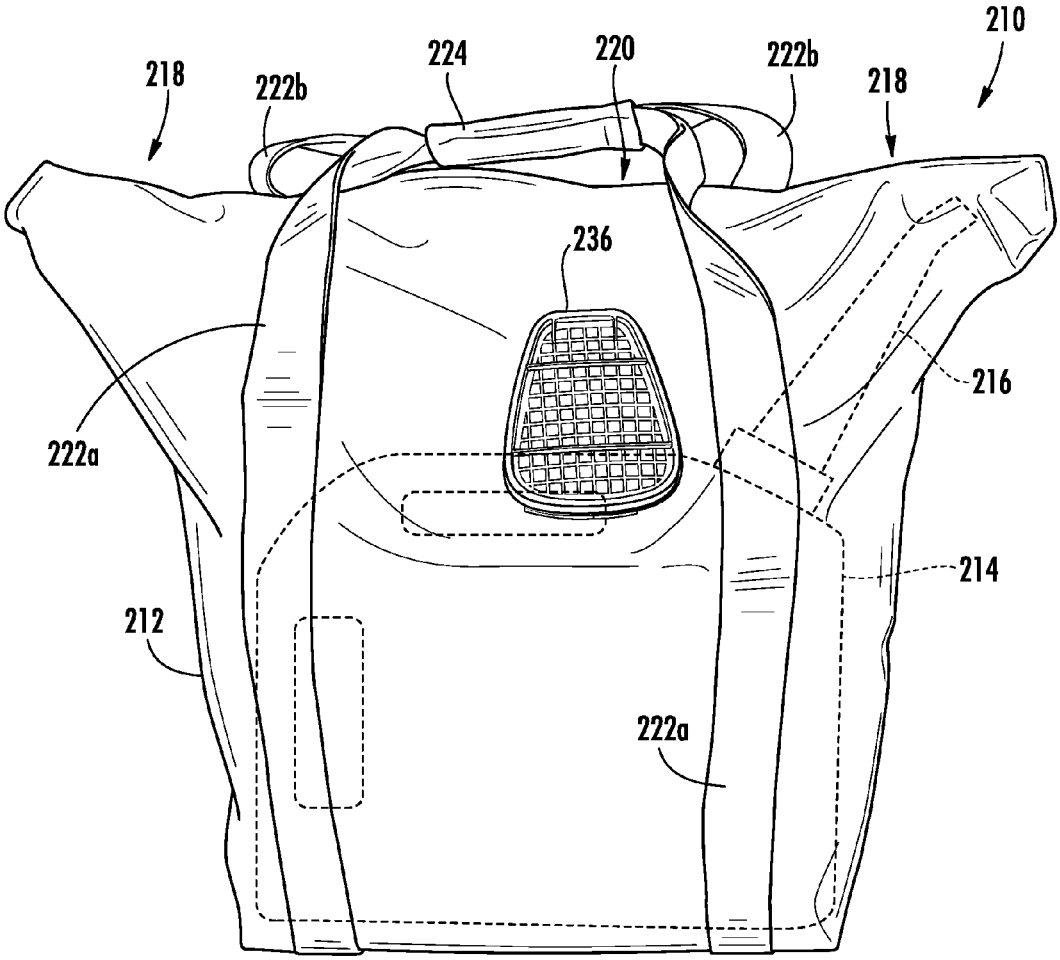
FIG. 9 is a side perspective view of another chemical container in accordance with the present invention.
Figure 10:
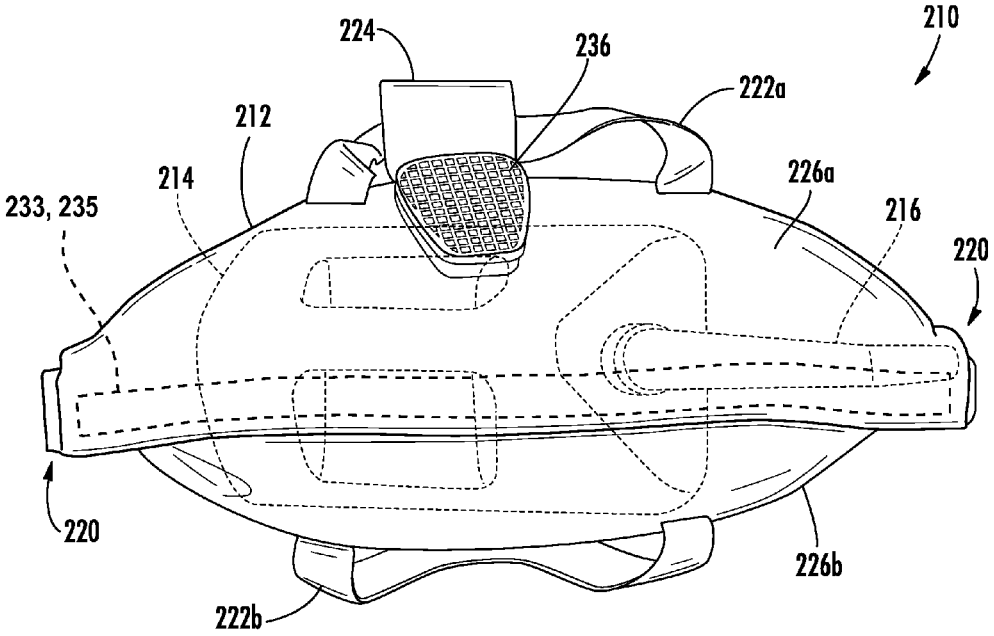
FIG. 10 is a top perspective view of the chemical container of FIG. 9.
Figure 11:
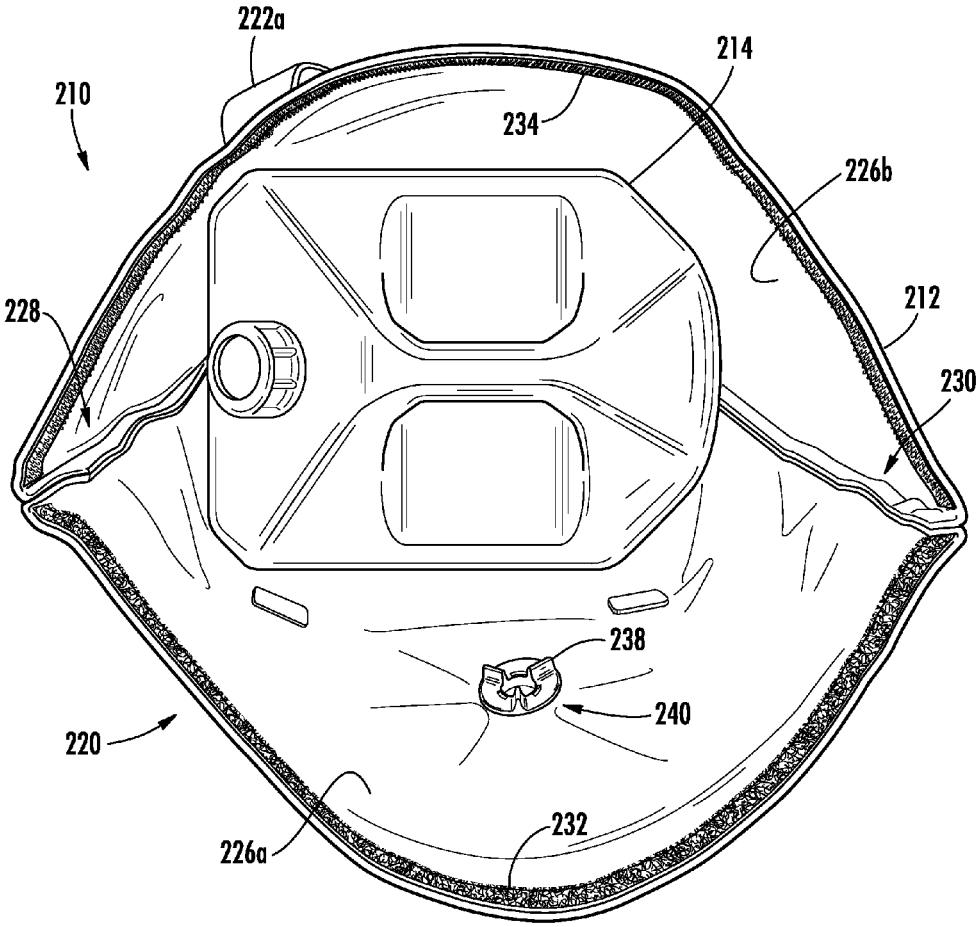
FIG. 11 is another top perspective view of the chemical container of FIG. 9, shown in an open configuration.

Optionally, and with reference to FIGS. 9-11, another chemical container or system 210, in the form of a soft-sided bag 212 that forms an outer enclosure for containing a conventional fuel canister or container 214, is similar in many respects to container 110, described above. Like container 110, chemical container 210 isolates a conventional fuel container 214 and vapors emitted by the container, from the outside environment. Soft-sided bag 212 is shaped to receive fuel container 214, which has a container spout 216 that is received in a spout-receiving portion 218 of bag 212. In the illustrated embodiment of FIGS. 9-11, bag 212 includes two spout-receiving portions 218 so that fuel container 214 may be positioned inside of the bag 212 in either of two orientations, with container spout 216 received in either of the spout-receiving portions 218. However, it will be appreciated that the container spout 216 may optionally be removed or placed in a stowed configuration, such as shown in FIG. 11, when fuel container 214 is positioned inside of the bag 212.

Bag 212 of chemical container 210 includes an openable upper region 220 that is closeable in a manner that seals or substantially limits or prevents the emission of vapors from inside bag 212 up through the openable upper region 220, as will be described in more detail below. Bag 212 further includes a pair of flexible straps 222*a*, 222*b* that form loops at their respective upper end portions, and which can be joined together at a handle portion 224 (FIGS. 9 and 10). Flexible straps 222*a*, 222*b* may be sewn, riveted, glued, bonded, or attached in a similar manner to the outer surface of bag 212, and may be formed from a single loop of strap material that extends underneath bag 212, from one side to the other, to provide a strong and secure carrying handle that can support considerable weight inside of the bag 212, while minimizing the risk of tearing of the bag.

As best shown in FIGS. 10 and 11, openable upper region 220 of bag 212 can be folded over on top of itself and secured in a folded or rolled configuration to substantially limit or prevent the escape of fumes or vapors from the interior of the bag. In the illustrated embodiment, soft-sided bag 212 is made from at least two sheets 226*a*, 226*b* of fabric material that are sewn and/or sealed together at opposite edge portions 228, 230, and which are releasably attachable to one another via a pair of hook and loop fastener strips 232, 234 along respective upper edges of fabric sheets 226*a*, 226*b* (FIG. 11). With fuel container 214 positioned inside of bag 212 between fabric sheets 226, 226*b*, hook and loop fasteners 232, 234 may be joined together to provide at least initial closure of the openable upper region 220 of bag 212. Optionally, at least one additional set of hook and loop fasteners 233, 235 (FIG. 10) may be provided along respective outer surfaces of fabric sheets 226*a*, 226*b* to provide a secondary closure or seal along openable upper region 220, when the upper region is folded or rolled as shown in FIGS. 9 and 10. For example, hook and loop fastener strip 233 may be positioned along an outer surface of fabric sheet 226*a*, directly opposite hook and loop fastener 232, with corresponding hook and loop fastener strip 235 positioned somewhat below but generally parallel to hook and loop fastener 234, along the outer surface of fabric sheet 226*b*. With this arrangement, when hook and loop fastener strips 232, 234 are attached to one another, openable upper region 220 may then be folded over to engage the other hook and loop fastener strips 233, 235 with one another, which cooperate to hold openable upper region 220 in the folded and closed configuration of FIGS. 9 and 10.

It will be appreciated that substantially any resealable or recloseable closure elements may be used along openable upper region 220, as long as the closure elements can maintain the openable upper region in a closed configuration along substantially the entire length of the upper region. For example, magnetic closures, zippers or other types of interlocking closures including fluid-resistant zippers such as those used on dry suits for divers, releasable adhesives, or the like may be used to secure the openable upper region 220 in a closed configuration. Although it is desirable to provide a substantially sealed or sealable closure at openable upper region 220, it will be appreciated that the function of container 210 (or any of the other containers described herein), will not be significantly affected by an imperfect seal provided by the closure (i.e., the closure need not be entirely fluid or gas-tight under pressure) because any gas pressure differential between the inside of bag 212 and the exterior of the bag will be readily equalized through a vapor filter cartridge 236 positioned along fabric sheet 226*a*, since the vapor filter cartridge exhibits generally low resistance to the flow of gases through the filter.

Vapor filter cartridge 236 is coupled to fabric sheet 226*a* via a filter mount 238 (FIGS. 11 and 13-15) that extends through a hole or opening 237 (FIG. 15) in fabric sheet 226*a*, and allows for releasable coupling of vapor filter cartridge 236 to bag 212. Filter mount 238 includes a gripping portion 240 that is positioned along an inner surface of fabric sheet 226*a*, as shown in FIG. 11, and a cartridge-engaging portion 242 that is generally annular in shape, and which projects outwardly through fabric sheet 226*a* to engage and secure vapor filter cartridge 236 as shown in FIGS. 9 and 10. Gripping portion 240 of filter mount 238 includes a generally disk-shaped flange portion 244 and three upstanding gripping elements 246 that extend outwardly from flange portion 244 (i.e., inwardly into bag 212), and are arranged radially outwardly from an opening or aperture 248 that is defined through flange portion 244 and cartridge-engaging portion 242.

Upstanding gripping elements 246 allow a user to apply torque to the filter mount 238 while installing or removing vapor filter cartridge 236. For example, each of the three upstanding gripping elements 246 of the illustrated embodiment may engage a respective one of the user's thumb, index finger, and middle finger of the user's right hand, for applying torque in a clockwise direction (as viewed from above in FIG. 13), and the upstanding gripping elements 246 could engage the same fingers of the user's left hand for applying torque in the opposite direction. It will be appreciated that substantially any number, size, or shape of upstanding gripping elements may be provided on the filter mount, or none at all, without departing from the spirit and scope of the present invention.

Flange portion 244 has a fabric-facing surface 244*a* (FIG. 14) that is contoured or shaped in a generally concentric or circular shape for providing a substantially vapor-tight seal between the flange portion 244 of the filter mount 238 and the fabric sheet 226*a* of bag 212. The fabric sheet 226*a* may be pinched between the fabric-facing surface 244*a* of flange portion 244, and a fabric-facing surface of vapor filter cartridge 236, so that substantially all of the flow of vapor or gases through fabric sheet 226*a* takes place through aperture 248 in filter mount 238. Optionally, a resilient gasket or other type of seal or sealant may be provided between fabric-facing surface 244*a* of flange portion 244 and fabric sheet 226*a* and/or between vapor filter cartridge 236 and fabric sheet

226*a*, to further limit or prevent vapors or gases from escaping bag 212 without passing through filter cartridge 236.

Figure 14:
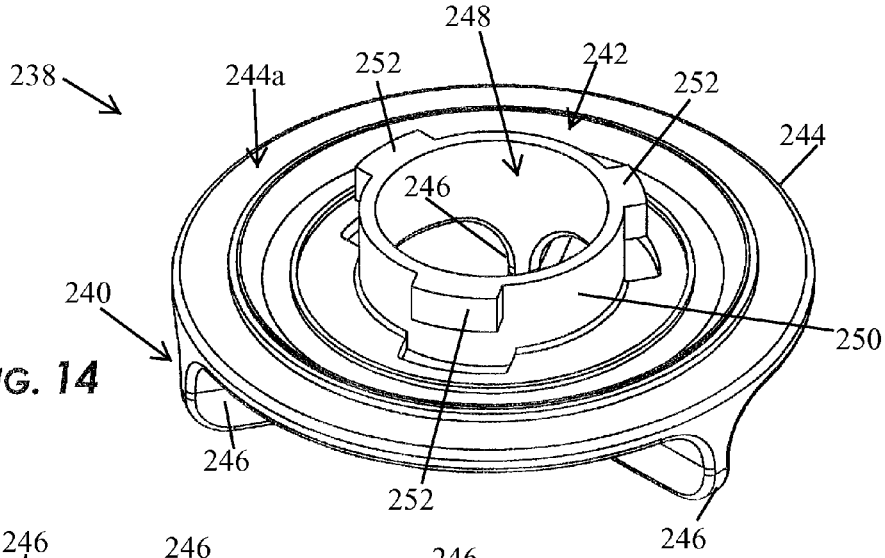
FIG. 14 is a perspective view of a filter-engaging portion of the filter-attachment nut of FIG. 13.
Figure 15:
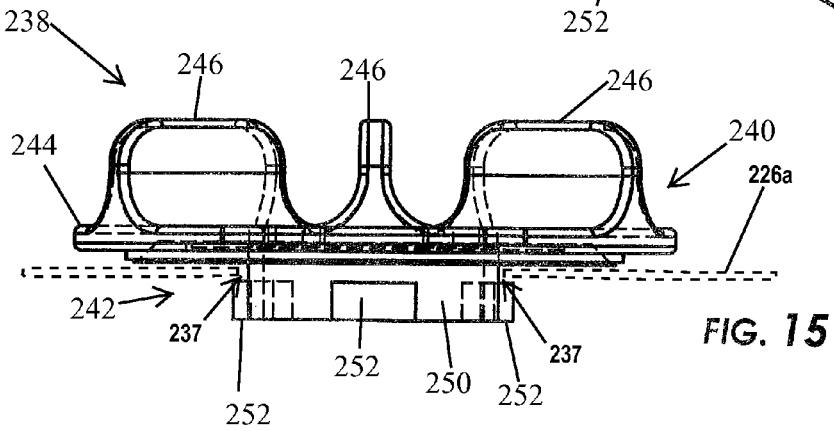
FIG. 15 is a side elevation of the filter nut of FIGS. 13 and 14.

Cartridge-engaging portion 242 of filter mount 238 is a hollow, generally cylindrical projection that extends outwardly from fabric-facing surface 244*a* of disk-shaped flange portion 244, as best shown in FIGS. 14 and 15. Cartridge-engaging portion 242 includes a hollow, generally cylindrical upstanding wall 250, which includes three radial projections 252 that are spaced outwardly away from fabric-facing surface 244*a* of flange portion 244. Upstanding wall 250 and radial projections 252 are sized and arranged to engage a corresponding twist-lock feature of vapor filter cartridge 236, so that vapor filter cartridge 236 may be radially attached and detached from filter mount 238 at fabric sheet 226*a*, such as for replacement of the cartridge 236. Thus, vapor filter cartridge 236 may be attached by aligning an opening in its housing that is shaped in a manner corresponding to upstanding wall 250 and radial projections 252, so that once the radial projections 252 are inserted into the housing of vapor filter cartridge 236, the cartridge may be rotated relative to filter mount 238 (such as by a user grasping the gripping portion 240 in one hand and the filter cartridge 236 in the other hand), and rotating the cartridge relative to the filter mount so that radial projections or tabs 252 are retained in the housing of the filter cartridge 236. Vapor filter cartridge 236 may be substantially any filter capable of filtering or adsorbing chemical gases such as organic vapors, including gasoline vapors. For example, suitable filtration and adsorption may be provided by 6000-Series filter cartridges, available from 3M Company of St. Paul, Minn.

Fabric sheets 226*a*, 226*b* may be made of any sufficiently strong, vapor-impervious or vapor-resistant material that resists degradation in the presence of liquid fuels and fuel vapors and the like. For example, bag 212 may be made from PVC-coated CORDURA® fabrics, which are abrasion-resistant, and which may be coated (such as along the inner surfaces of the bag) to reduce their vapor and liquid permeability, while remaining flexible at a wide range of temperatures. Optionally, rigid or semi-rigid materials may be used, or combinations of rigid and/or semi-rigid and/or flexible materials may be used, without departing from the spirit and scope of the present invention.

Figure 12:
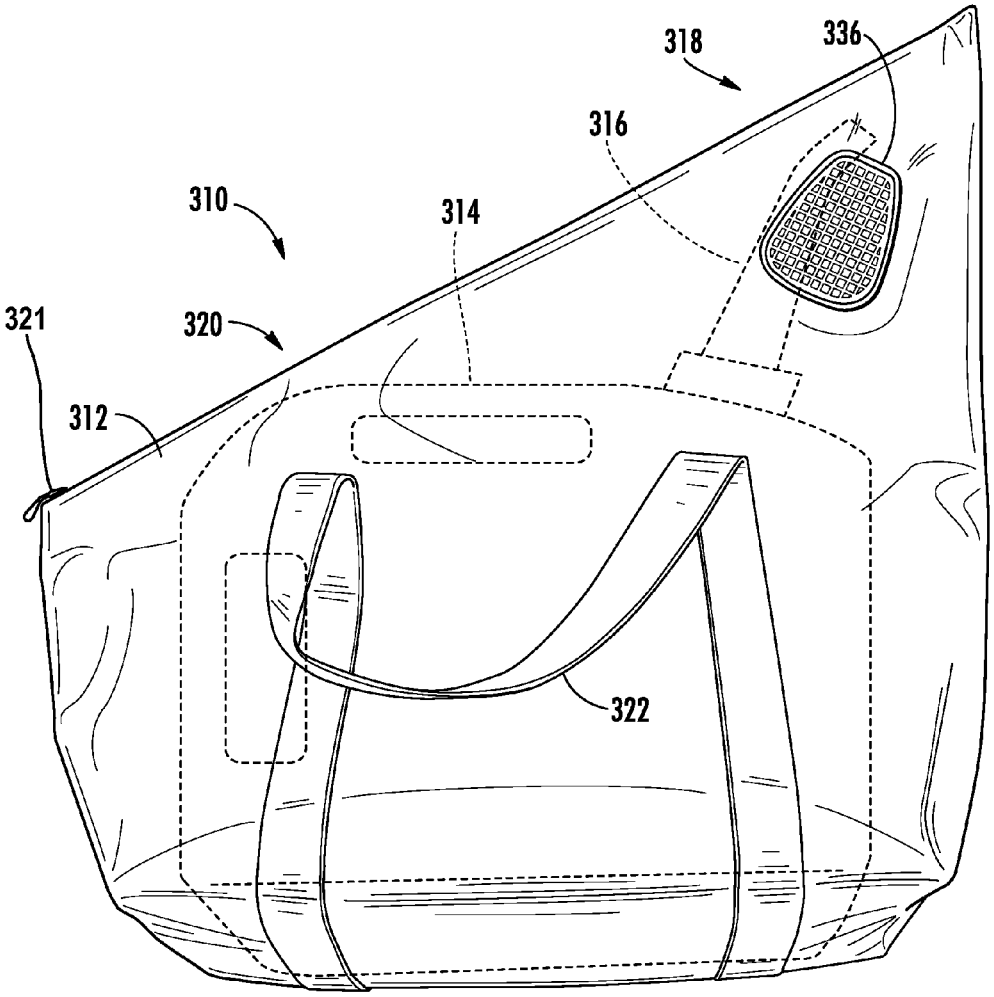
FIG. 12 is a side perspective view of another chemical container in accordance with the present invention.
Figure 13:
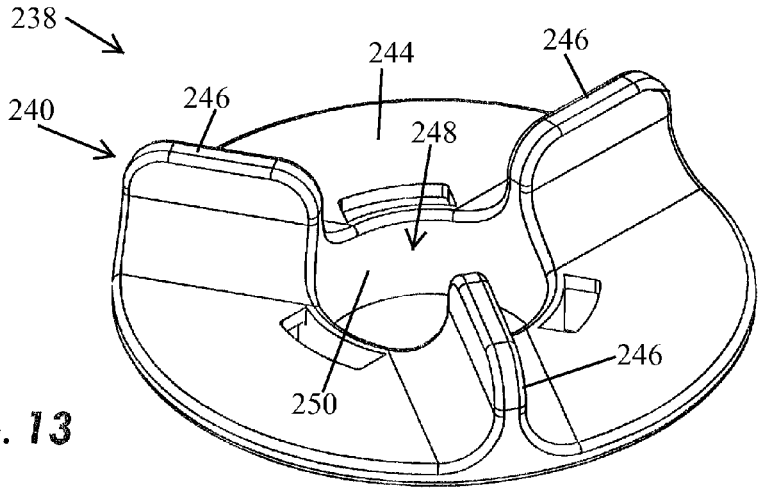
FIG. 13 is a perspective view of a gripping portion of a filter-attachment nut for use with the chemical containers of FIGS. 8-12.

Optionally, and with reference to FIG. 12, another chemical container or system 310 may be substantially similar to chemical container 210, described above, except that chemical container 310 is made of a soft-sided bag 312 having just one spout-receiving portion 318 to provide space for a container spout 316 of a fuel container 314. In all other respects, chemical container 310 may be substantially similar to container 210. Chemical container 310 includes an openable upper region 320 fastened by a zipper 321, flexible straps 322 for carrying the container, and a vapor filter cartridge 336 that is attached to bag 312 via a filter mount that is identical or substantially similar to filter mount 238, described above. Chemical container 310 has a somewhat sleeker appearance while requiring less fabric material than container 210, and still provides sufficient space for the fuel container 314 with its spout 316 positioned external to the container, albeit typically in only one orientation (i.e., with spout 316 disposed in spout-receiving portion 318 of bag 312).

Accordingly, the chemical containers of the present invention provide for filtration of malodorous and/or potentially harmful vapors associated with chemicals, and particularly liquid chemicals such as fuels and the like. The device includes a first container that contains the liquid chemical from which the undesirable vapors may be released, and a second container that is sealed around at least a portion of the first container. Because liquid chemical containers, and particularly fuel canisters or containers, may be vented or may not completely seal against the escape of vapors from the container, the second containers and vapor filters associated therewith serve to contain and filter or adsorb the vapors so that the vapors are not emitted into the surrounding environment, which may be particularly beneficial when the chemical containers are stored or transported in confined spaces occupied by humans or other animals or materials that could be adversely affected. In addition, the second container may provide an added benefit of containing leaks or spills so that the liquid or dry chemicals are not emitted to the environment.

It will be appreciated that chemical or fuel containers that are designed to vent gases or vapors when excessive vapor pressure builds up inside of the container may benefit particularly from aspects of the present invention by allowing gases to be safely vented from the container without venting the malodorous or potentially harmful gases or vapors into the surrounding environment. Thus, the present invention may meet or exceed stringent environmental regulations such as those promulgated by the California Air Resources Board (CARB).

These and other objects, advantages, purposes, and features of the present invention may be carried out without departing from the principles of the present invention, which is intended to be limited only by the scope of the appended claims as interpreted according to the principles of patent law including the doctrine of equivalents.

The invention claimed is:

1. A portable chemical container with vapor filtration, said chemical container comprising:

a first container defining a first chamber for storing a chemical, and said first container configured to selectively dispense the chemical;

a second container surrounding at least a portion of said first container and defining a second chamber between at least a portion of said second container and said portion of said first container that is surrounded by said second container, said second chamber for containing a gaseous vapor of the chemical from said first container, and said second container having at least one wall portion and an openable and closable portion;

a vapor filter at said at least one wall portion of said second container, said vapor filter in fluid communication with said second chamber and with the ambient environment; and wherein said vapor filter is configured to adsorb the gaseous vapor of the chemical from said second chamber and to vent filtered or cleansed air to the ambient environment.

2. The chemical container of claim 1, wherein said second container is sealed to a top portion of said first container and does not completely surround said first container, and wherein said second chamber is defined between said second container and said top portion of said first container.

3. The chemical container of claim 2, wherein said first container and said second container are substantially rigid.

4. The chemical container of claim 3, wherein said openable and closable portion of said second container comprises a removable lid that forms a top wall of said second container when said removable lid is attached to said at least one wall portion of said second container.

5. The chemical container of claim 4, wherein said second container is configured to support another chemical container in stacked arrangement atop said removable lid when said removable lid is attached to said at least one wall portion.

6. The chemical container of claim 1, wherein said first container comprises a dispensing spout that is positionable at a dispensing configuration at least when said openable and closable portion of said second container is opened.

7. The chemical container of claim 1, wherein said second container is configured to completely surround said first container, and wherein said second chamber is defined between said second container and the entirety of said first container.

8. The chemical container of claim 7, wherein said first container is substantially rigid and said second container is made of a flexible sheet material.

9. The chemical container of claim 8, wherein said openable and closable portion of said second container comprises at least one of (i) an interlocking closure, (ii) a releasable adhesive closure, (iii) a magnetic closure, (iv) a zipper closure, and (v) a hook-and-loop closure.

10. The chemical container of claim 8, further comprising a filter mount coupled to said flexible sheet material of said second container, said filter mount defining a fluid passageway and having a gripping portion positioned in said second chamber and a filter-engaging portion extending outwardly through said flexible sheet material, wherein said filter engaging portion is configured to releasably secure said vapor filter to said second container with said vapor filter in fluid communication with said second chamber via said fluid passageway.

11. The chemical container of claim 1, wherein said vapor filter comprises an activated charcoal adsorbent filter.

12. The chemical container of claim 1, wherein said first container is adapted to contain a liquid fuel in said first chamber, and wherein said second container is adapted to contain gaseous fuel vapors substantially without emitting the fuel vapors to the ambient environment.

13. A portable fuel container system comprising:

an outer enclosure defining a chamber for receiving a fuel canister and having a closable opening through which the fuel canister may be inserted or removed from said chamber;

a closure member at said closable opening of said outer enclosure, said closure member configured to selectively retain said closable opening in a closed configuration with the fuel canister positioned in said chamber of said outer enclosure; and a vapor filter at said outer enclosure and in fluid communication with said chamber and with the ambient environment, said vapor filter being configured to adsorb fuel vapors emitted by the fuel canister into said chamber.

14. The portable fuel container system of claim 13, wherein said outer enclosure defines at least one spout-receiving portion of the chamber, the spout-receiving portion configured to receive a dispensing spout of the fuel canister.

15. The portable fuel container system of claim 14, wherein said outer enclosure defines two of said spout-receiving portions, each of said spout-receiving portions configured to receive the dispensing spout of the fuel canister when the fuel canister is in a different orientation within said chamber.

16. The portable fuel container system of claim 13, further comprising a fuel canister having a dispensing spout, said fuel canister configured to contain a liquid fuel and to selectively dispense the liquid fuel via said dispensing spout.

17. The portable fuel container system of claim 13, wherein said closure member comprises at least one of (i) an interlocking closure, (ii) a releasable adhesive closure, (iii) a magnetic closure, (iv) a zipper closure, and (v) a hook-and-loop closure.

18. The portable fuel container system of claim 13, wherein said outer enclosure comprises at least one of (i) a sheet film material and (ii) a coated fabric sheet material.

19. The portable fuel container system of claim 18, wherein:

said outer enclosure comprises outer surfaces and inner surfaces, said inner surfaces defining said chamber;

said closure member comprises a double closure including a first corresponding pair of closure members disposed along respective ones of said inner surfaces of said outer enclosure at said closable opening, and a second corresponding pair of closure members disposed along respective ones of said outer surfaces of said outer enclosure; and said closure members of said second corresponding pair are arranged to engage one another to thereby releasably hold said closable opening in said closed configuration when said closure members of said first corresponding pair engage one another and said outer enclosure is folded or rolled at said closable opening.

20. The portable fuel container system of claim 13, further comprising a filter mount coupled to said outer enclosure, said filter mount defining a fluid passageway and having a gripping portion configured to be grasped by a user's hand and a filter-engaging portion extending outwardly through said outer enclosure, wherein said filter-engaging portion is configured to releasably secure said vapor filter to said outer enclosure with said vapor filter in fluid communication with said second chamber via said fluid passageway.

21. A portable fuel container system comprising:

a flexible fabric outer container defining a chamber for receiving a fuel canister, said outer container having a closable opening through which the fuel canister may be inserted or removed from said chamber, and said outer container defining a spout-receiving portion of said chamber proximate said closable opening for receiving a dispensing spout of the fuel canister;

a double closure including a first corresponding pair of closures disposed along said outer container at said closable opening, and a second corresponding pair of closures disposed along said outer container near said closable opening, wherein said second corresponding pair of closures are arranged to engage one another to thereby releasably hold said closable opening in said closed configuration when said first corresponding pair of closures engage one another and said outer enclosure is folded or rolled at said closable opening;

a filter mount coupled to said outer container, said filter mount defining a fluid passageway through said outer container and having a gripping portion disposed inside of said container and a generally annular filter-engaging portion extending outwardly through said outer enclosure, said gripping portion having a plurality of upstanding gripping elements; and a vapor filter cartridge releasably secured to said filter-engaging portion of said filter mount at said outer container, whereby said vapor filter cartridge is in fluid communication with said chamber via said fluid passageway of said filter mount, said vapor filter being configured to adsorb fuel vapors emitted by the fuel canister into said chamber and to vent filtered air to the ambient environment.

* * * * *